US008388251B2

(12) United States Patent
Lee

(10) Patent No.: US 8,388,251 B2
(45) Date of Patent: Mar. 5, 2013

(54) WRITING INSTRUMENT WITH A MULTIVARIATE MECHANICAL DOLL

(76) Inventor: Pao-Feng Lee, Taipei (TW)

( * ) Notice: Subject to any disclaimer, the term of this patent is extended or adjusted under 35 U.S.C. 154(b) by 511 days.

(21) Appl. No.: 12/756,192

(22) Filed: Apr. 8, 2010

(65) Prior Publication Data

US 2011/0044747 A1 Feb. 24, 2011

Related U.S. Application Data

(63) Continuation-in-part of application No. 12/461,629, filed on Aug. 19, 2009, now Pat. No. 8,182,165.

(51) Int. Cl.
*B43K 29/00* (2006.01)

(52) U.S. Cl. ..... 401/195; 74/469

(58) Field of Classification Search ..... 74/469; 401/195

See application file for complete search history.

(56) References Cited

U.S. PATENT DOCUMENTS 6,254,298 B1 * 7/2001 Hsu ..... 401/195
6,332,727 B1 * 12/2001 Hsu ..... 401/195
6,688,794 B1 * 2/2004 Hsu ..... 401/195
7,097,377 B1 * 8/2006 Rigoni ..... 401/195
2011/0176856 A1 * 7/2011 Gardner et al. ..... 401/195

* cited by examiner

*Primary Examiner* — David M Fenstermacher

(57) ABSTRACT

A writing instrument with a multivariate mechanical doll consists of an elongated pen body having a seat mounted on an end thereof, a working piece and a doll. The action of the doll is in response to the mechanism of the working piece which is driven by extending and retracting the refill within the pen body. The doll which composes of a frontal and a rear casing incorporates a decorating object pin jointed to the working piece. Said seat includes a plate which attaches to the rear casing extended upwardly from a top thereof; and a rail is provided at a frontal portion of said plate and a locating post is provided at a rear portion thereof. The locating post is sheathed by a spring and engages to a male junction piece. Said junction piece connects to a female junction piece which fastened onto the frontal casing and engaged with a third driving element of the working piece which has a waving surface. The waving surface exerts and lifts the frontal casing allowing the decorating object to expose. The frontal casing can be replaced without any tool required.

8 Claims, 6 Drawing Sheets

WRITING INSTRUMENT WITH A MULTIVARIATE MECHANICAL DOLL

This application is a Continuation-In-Part of application Ser. No. 12/461,629, filed on Aug. 19, 2009, now U.S. Pat. No. 8,182,165.

FIELD OF THE INVENTION

The present invention relates to a writing instrument having an amusement mechanical doll whose appearance is exchangeable.

DESCRIPTION OF PRIOR ART

An ornament is usually applied or mounted on our daily used objects for increasing the beauty or providing appearance changing. An ornament can also be a symbol of fashion as it usually represents the preference of a user or the society. An integral molded figure of animal, famous cartoon characters or other objects are often mounted on a pen, chopsticks or others rod-like objects for attracting sight of others. However, such monotonic decoration bores the user easily. Some ornaments are provided with movable parts, thus, movement can be observed during the usage of the objects. Such design improves the amusement of the decoration but it lacks novelty since the objected won't respond the moving of the ornament. In the prior design, U.S. application Ser. No. 12/461,629, applicant disclosed a pen coupling a mechanical toy; said mechanical toy is driven by the action of the refill of the pen to open the frontal portion thereof and extend or retract a relatively smaller decorating object. The mechanical toy brings amusing factor to the user. However, the frontal casing of the toy must be opened widely to extend and retract the decorating object slowing the speed of the action and the decorating object is not concealed securely within the toy which may jam the mechanism. Further, to replace the frontal casing of the toy, a specific tool, such as screw driver is required, causing inconvenience to minor user. Therefore, to provide an ornament with faster reaction, more reliability and tooless exchangeable frontal casing has become objectives of the present invention.

SUMMARY OF THE INVENTION

To achieve aforementioned objectives, a writing instrument with a multivariate mechanical doll comprises of an elongated pen body having a seat mounted on an end thereof, a doll covers said seat, and a working piece engages with the seat to drive movement of doll; said working piece consists essentially of a shaft which attaches to the seat and slides within said pen body, a first driving element incorporated in the doll in response to the action of said shaft, a second driving element pin jointed to said first driving element and seat respectively, a third driving element pin jointed to said second driving element, and a plurality elastic elements incorporated in said body for providing reciprocal movement; said doll which composes of a frontal and a rear casing incorporates a decorating object pin jointed to said second driving element. Said mechanical toy is characterized in that the seat includes a plate which attaches to the rear casing extended upwardly from a top thereof; a rail is provided at a frontal portion of said plate and a locating post is provided at a rear portion thereof; the locating post is sheathed by a spring and engages to a male junction piece; said junction piece connects to a female junction piece which fastened onto the frontal casing and engaged with the third driving element; said third driving element has a waving surface. The slit by separating the frontal and rear casing is in response of the waving amplitude of said waving surface. By setting a gentle waving structure, the slit is relatively narrower for increasing the reaction time of the mechanism.

Said frontal and rear casings are coupled by engaging the male and female junction pieces attached thereto respectively. The engagement is detachable, thus the user can replace the frontal casing without specific tool. The frontal casing of the doll shows a facial configuration of a character, exchangeable frontal casing increasing the amusing and multivariate factors of the doll.

DETAILED DESCRIPTION OF PREFERRED EMBODIMENT

The preferred embodiments of the present invention are described in details according to appended drawings hereinafter.

Figure 1:
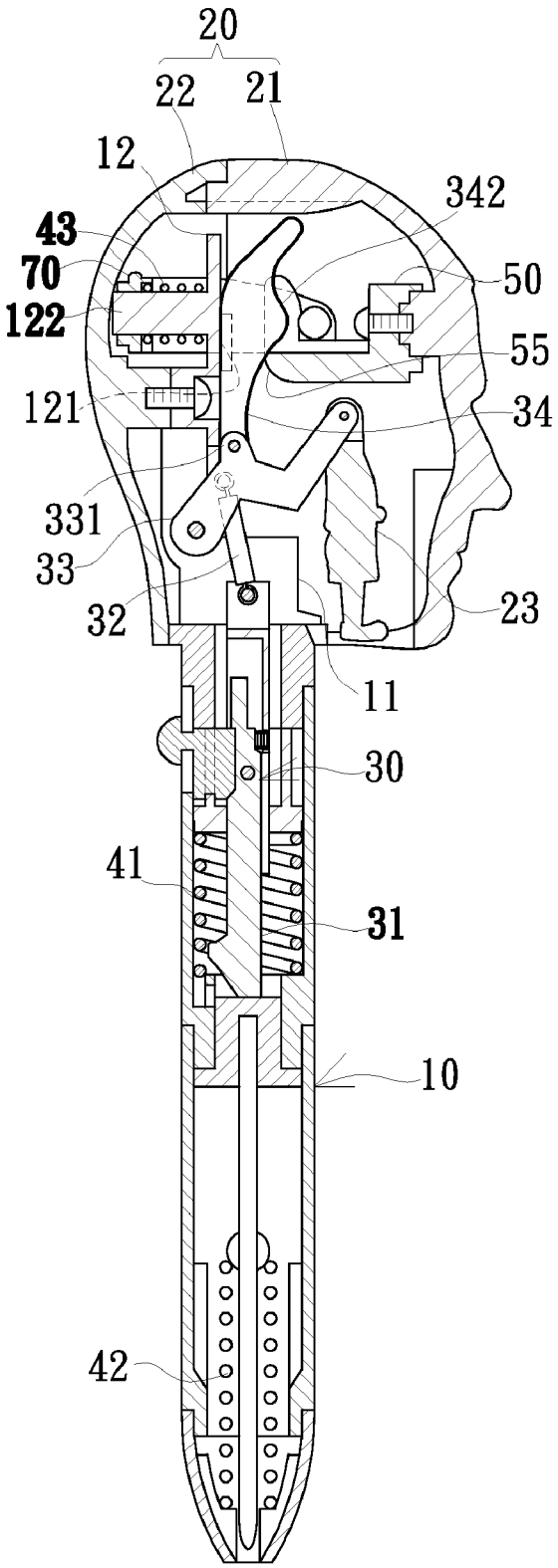
FIG. 1 is a cross-sectional view of the present invention.
Figure 2:
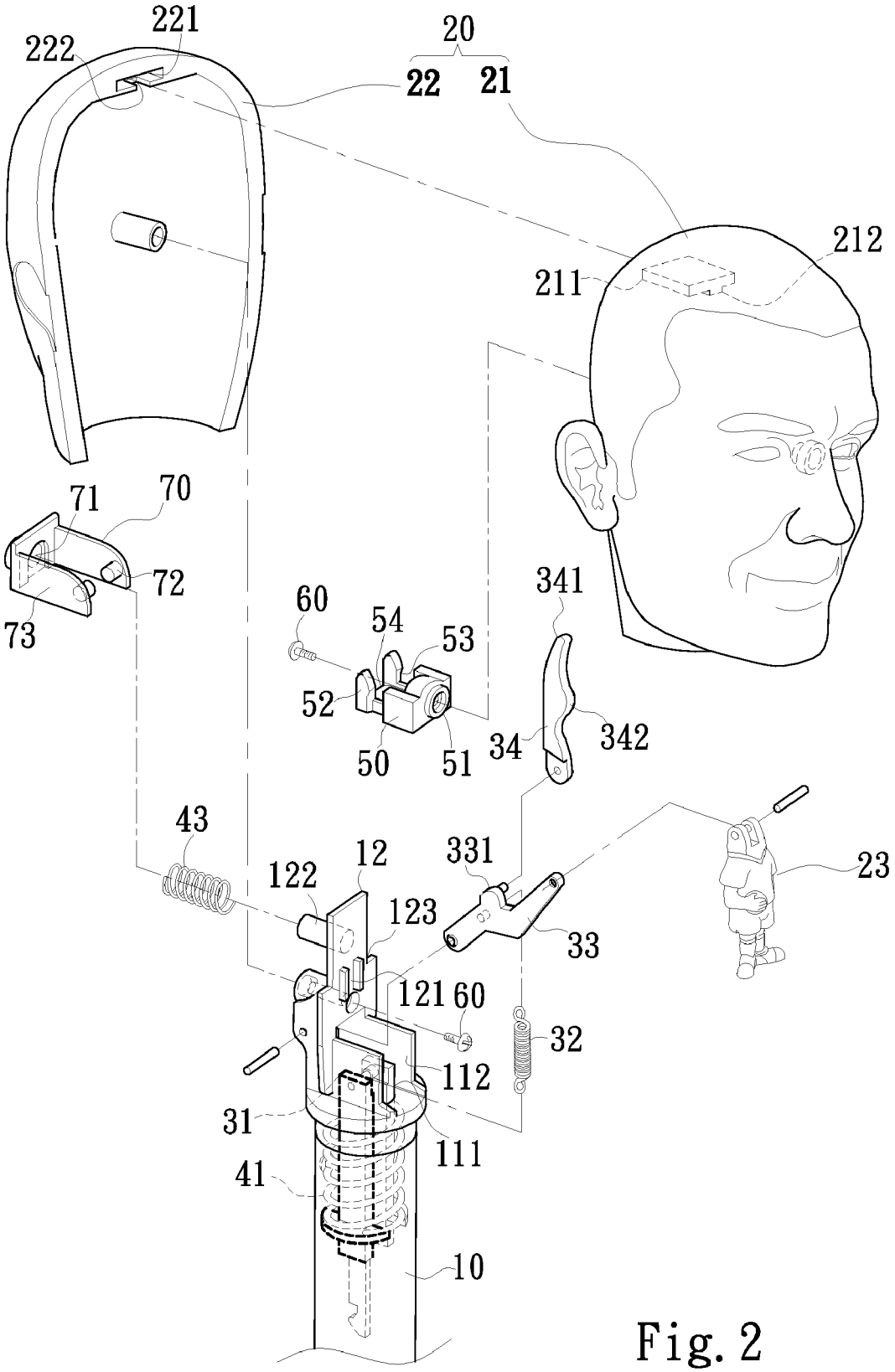
FIG. 2 is an exploded view of the mechanical doll of the present invention.
Figure 3:
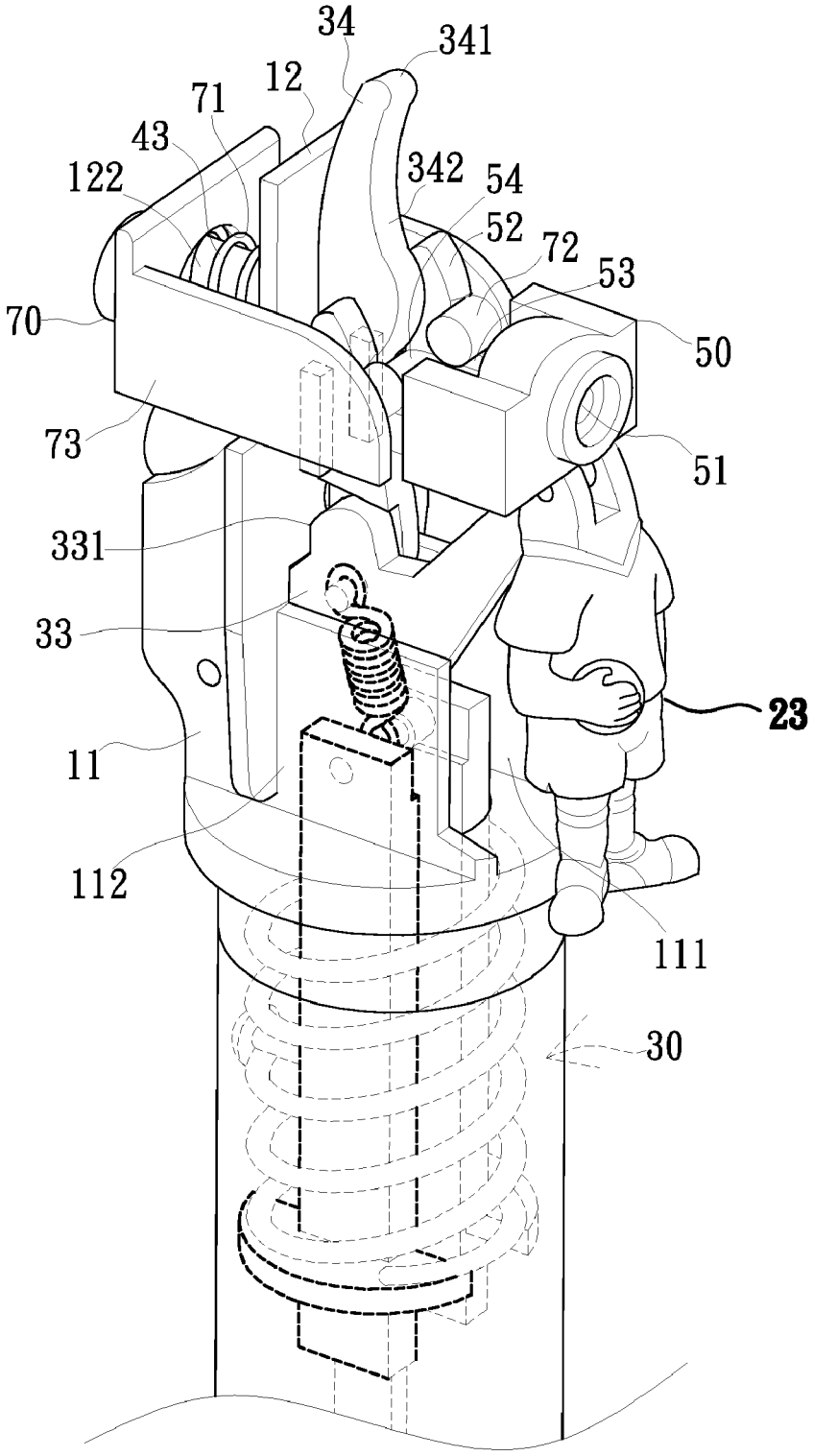
FIG. 3 is a perspective view of the mechanical doll of the present invention.

Referring to FIGS. 1-3, a writing instrument with a multivariate mechanical decoration comprises of an elongated pen body (10) having a seat (11) mounted on an end thereof, a doll (20) houses said seat (11), and a working piece (30) engages with the seat (11) to drive movement of doll (20); said working piece (30) consists essentially of a shaft (31) which attaches to the seat (11) and slides within said pen body (10), a first driving element (32) incorporated in the doll (20) in response to the action of said shaft (31), a second driving (33) element pin jointed to said first driving element (32) and seat (11) respectively, a third driving element (34) pin jointed to said second driving element (33), and a plurality elastic elements (41, 42) are incorporated in said body (10) for providing reciprocal movement; said doll (20) which is composed of a frontal (21) and a rear casing (22) incorporates a decorating object (23) pin jointed to said second driving element (33). The frontal casing (21) is pushed and lifted in response of the action of the working piece (30) to open a slit, allowing the decorating object (23) being extended and retracted. Functions and structures of said shaft (31), first driving element (32) and elastic elements (41, 42) which are for driving the mechanism of the working piece (30) are the same as disclosed in the prior application which no further statement will be described herewith.

By referring to FIG. 2, the mechanical doll claimed in the present invention is characterized in that the seat (11) includes a plate (12) which is attached to the rear casing (22) by extending upwardly from a top thereof; a rail (121) is provided at a frontal portion of said plate (12) to allow the third driving element sliding reciprocally within and a locating post (122) is provided at a rear portion thereof; the locating post (122) is sheathed by a spring (40) and engages to a male junction piece (70); said junction piece (70) connects to a female junction piece (50) which is fastened onto the frontal casing (21) and engaged with the third driving element (34) which has a waving surface (342) for engaging the female junction piece (50) and opening the doll (20).

The waving amplitude of the surface (342) determines the size of the gap between the frontal and rear casings (21, 22), made by exerting said female junction piece (50) for extending the decorating object (23). A sharp amplitude generates a wider opening while a flat amplitude generates a relatively narrower slit; narrow slit or gap reduces the reaction time of the mechanism and may raise the curiosity of the user since the internal mechanism of the doll can't be observed from the slit.

Said frontal casing (21) joins the rear casing (22) by engaging the female junction piece (50) and the male junction piece (70). Said female junction piece (50) is screwed onto the frontal casing (21) and the male junction piece (70) is attached to the seat (11) and screwed onto the rear casing. The engagement of said male and female junction pieces (70, 50) are detachable, thus the user can simply replace the frontal casing (21) without any specific tool. As shown in FIG. 2, the fontal casing (21) can be made with facial figure of a person; it is expected that frontal casing (21) with face or head portion of famous characters or customize facial configuration of the user can be made for exchanging purpose.

Said second driving element (33) has a projected portion (331) pin jointed an end of said third driving element (34) and butted to said plate (12) for restraining the movement of the third driving element (34). Another end of said third driving element (34) is a free end (341) and the surface where the third driving element (34) butting said plate (12) is in a convex curved shape.

The female junction piece (50) includes a recessed portion (54) for receiving the waving surface (342) of the third driving element (34) and a curved surface (55) is provided at a bottom of the recessed portion (54) to correspond with the waving surface (342).

Said male junction piece (70) is in a U-shape, having an axial hole (71) provided horizontally for engaging the locating post (122).

An arm (73) is extended respectively from two lateral sides of the male junction piece (70) and a slit (123) is disposed at two lateral sides of the plate (12) for allowing the arms (73) to pass.

A locking post (72) is extended inwardly from each of said arms (73) for engaging the female junction piece (50). Said female junction piece (50) includes a connecting portion (51) provided at frontal side thereof for coupling with the frontal casing (21) and a hook (52) provided respectively at two lateral sides of rear side thereof; a recess (53) is formed between the connecting portion (51) and hooks (52) for accommodating the locking posts (72) of both arms (73).

The seat (11) includes a central recess (111) formed by two side walls (112) which serve as a support of the seat (12).

As shown in FIG. 2, a latch (211) and a rib (212) are provided at top inner side of the frontal casing (21), forming a T-shape projection, corresponding and matching to a T-shape recess portion formed by a groove (221) and a slit (222) provided at top inner side of the rear casing (22). By engaging the T-shaped projection with said T-shaped recess, the frontal casing (21) can be pivotally opened as shown in FIG. 4.

Figure 4:
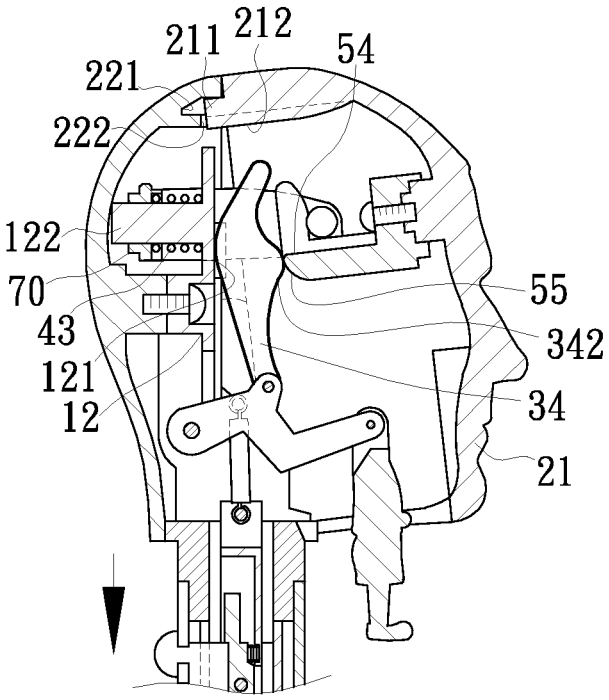
FIGS. 4 and 5 are cross-sectional views showing deployment of a decorating object concealed within the doll.

Referring further to FIG. 4, said third driving element (34) is accommodated within the rail (12) for maintaining its reciprocal movement rectilinearly. A convex portion of said waving surface (342) exerts the curved surface (55), and since the female junction piece (50) is fastened with the frontal casing (21), the convex portion lifts the casing (21) forwardly. The cylindrical locking post (73) functions as a pivot as said frontal casing (21) is pushed. The spring (43) which sheathing the locating post (122) is a compression spring, and by installing the spring (43) between the plate (12) and the male junction piece (70), said frontal casing (21) is held to avoid widely opened exposing the internal structure thereof.

Figure 5:
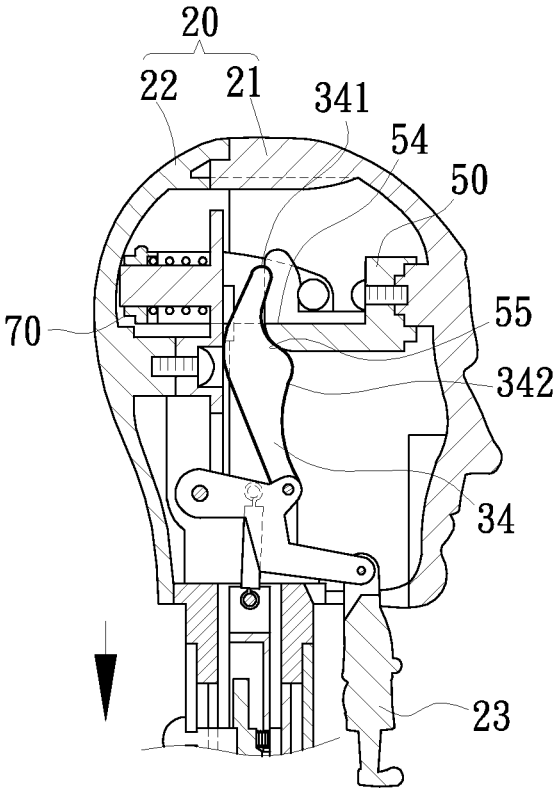
Figure 6:
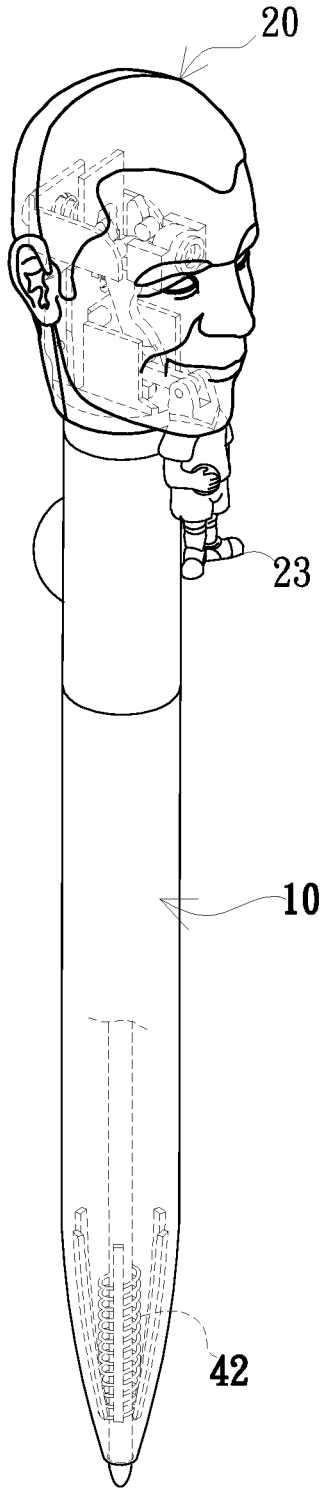
FIG. 6 is a perspective view of the present invention.

Referring to FIG. 5, as the curved surface (55) engages the concave portion of the waving surface (342), the decorating object (23) is extended from the inside of the doll (20), as shown in FIG. 6. After the object (23) is exposed, said frontal casing (21) is pulled back to the original position. Said recessed portion (54) disposed on the female junction piece (50) can receives the free end (341) of said third driving element (34), preventing jamming of the mechanism from the disengagement.

Figure 7:
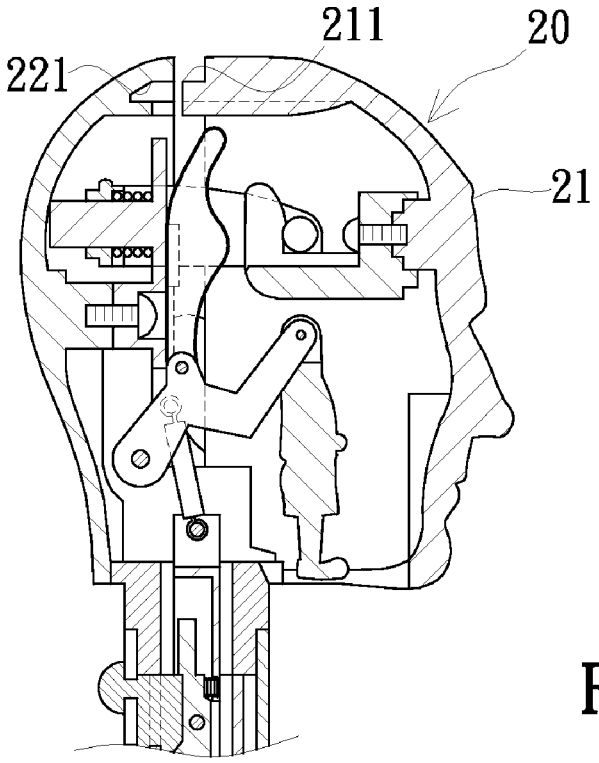
FIGS. 7-9 are cross-sectional views showing the required procedures of removal of a demountable frontal casing of the doll.
Figure 8:
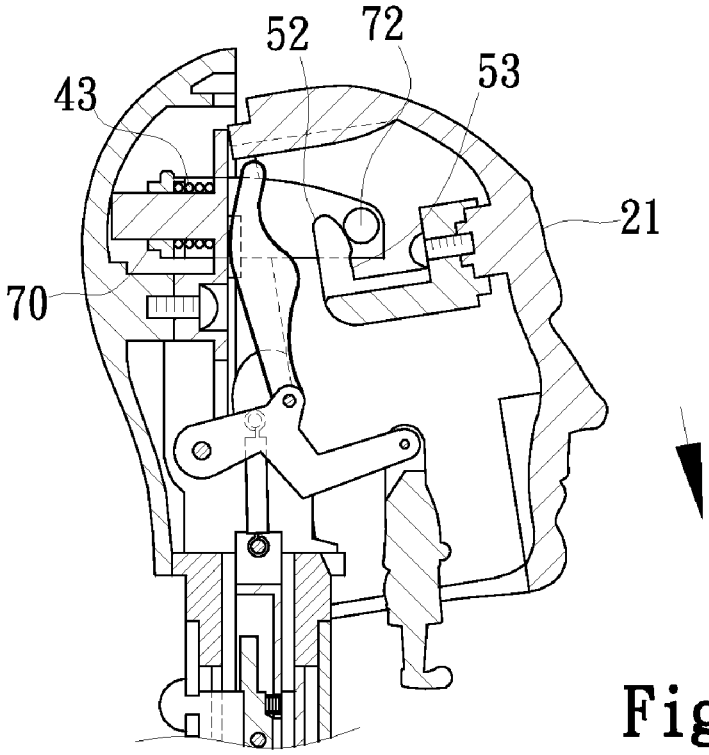
Figure 9:
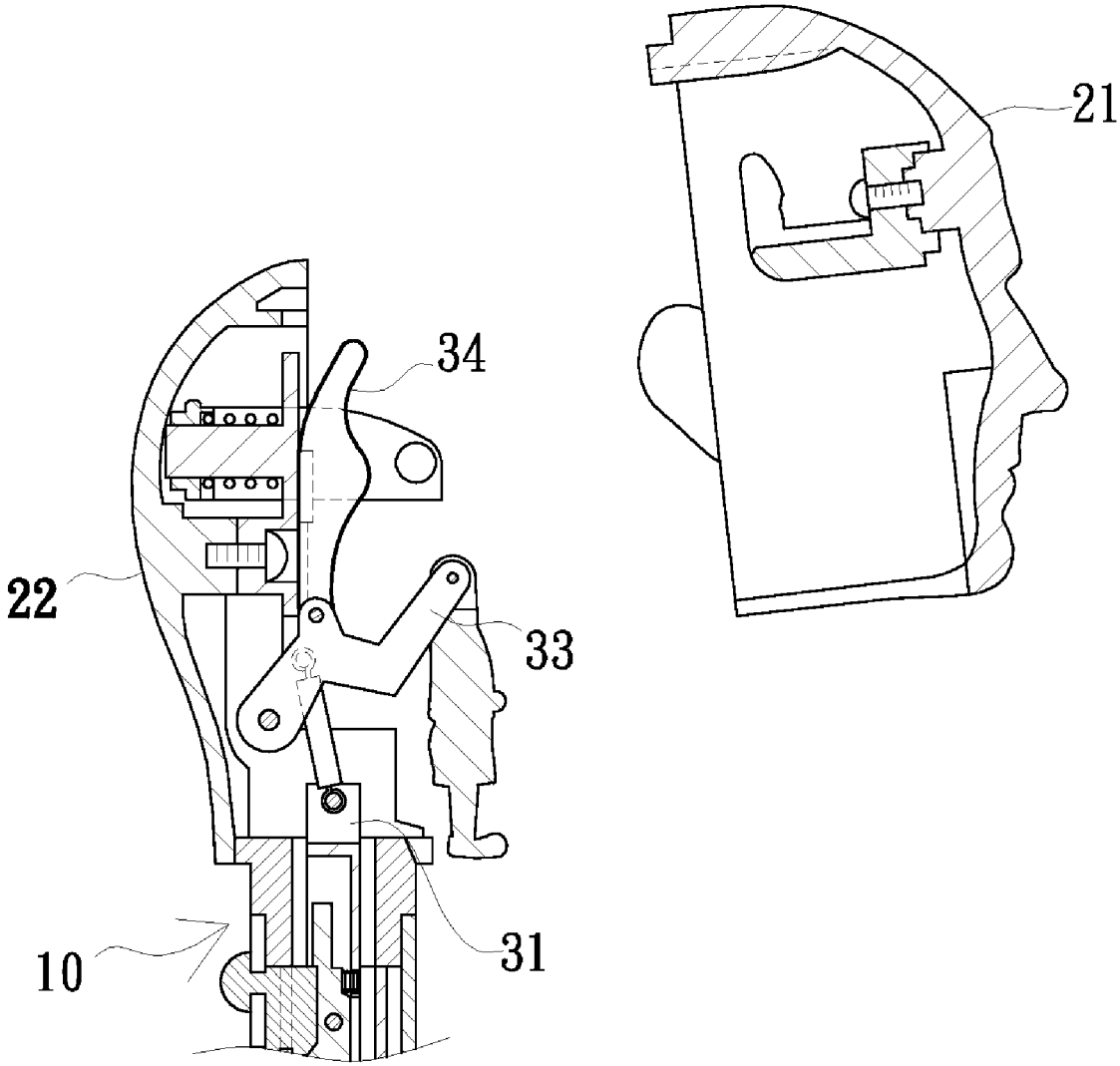

The method for replacing said frontal casing (21) is described referring to FIGS. 7-9. As shown in FIG. 7, the frontal casing (21) is pulled forwardly until the latch (211) disengages said groove (221) completely. Said frontal casing (21) is slightly rotated as illustrated in FIG. 8 for disengaging the locking post (72) from the recess (53). An upper portion of the hook (52) has an angled surface allowing the locking post (72) to move smoothly as said male junction piece (70) is retracted by the spring (43) for facilitating the disengagement. FIG. 9 shows a frontal casing (21) disengaged completely from the doll (20); and for installing a frontal casing (21), above processes are operated reversely, which will not be described herewith.

The invention claimed is:

1. A writing instrument with a multivariate mechanical doll comprises of an elongated pen body having a seat mounted on an end thereof, a doll covers said seat, and a working piece engages with the seat to drive movement of doll; said working piece consists essentially of a shaft which attaches to the seat and slides within said pen body, a first driving element incorporated in the doll in response to the action of said shaft, a second driving element pin jointed to said first driving element and seat respectively, a third driving element pin jointed to said second driving element, and a plurality elastic elements incorporated in said body for providing reciprocal movement; said doll which composes of a frontal and a rear casing incorporates a decorating object pin jointed to said second driving element and is characterized in that:

said seat includes a plate which attaches to the rear casing extended upwardly from a top thereof; a rail is provided at a frontal portion of said plate and a locating post is provided at a rear portion thereof; the locating post is sheathed by a spring and engages to a male junction piece; said junction piece connects to a female junction piece which fastened onto the frontal casing and engaged with the third driving element; said third driving element has a waving surface.

2. The writing instrument with a multivariate mechanical doll of claim 1, wherein said second driving element has a projected portion pin jointed an end of said third driving element and butted to said plate; an another end of said third driving element is a free end and a surface butting said plate is a convex curved shape.

3. The writing instrument with a multivariate mechanical doll of claim 1, wherein said female junction piece has a recessed portion for receiving the waving surface of the third driving element and a curved surface is proved at a bottom of the recessed portion to correspond with the waving surface.

4. The writing instrument with a multivariate mechanical doll of claim 1, wherein said male junction piece is in a U-shape, having an axial hole provided horizontally for engaging the locating post.

5. The writing instrument with a multivariate mechanical doll of claim 1, wherein an arm is extended respectively from two lateral sides of the male junction piece and a slit is disposed at two lateral sides of the plate for allowing the arms passing.

6. The writing instrument with a multivariate mechanical doll of claim 1, wherein a locking post is extended inwardly from each of said arms for engaging the female junction piece; said female junction piece includes a connecting portion provided at frontal side thereof for coupling with the frontal casing and a hook provided at two lateral sides of rear side thereof; a recess is formed between the connecting portion and hooks for accommodating the locking posts of the arms.

7. The writing instrument with a multivariate mechanical doll of claim 1, wherein the seat includes a central recess formed by two side walls.

8. The writing instrument with a multivariate mechanical doll of claim 1, wherein a latch is provide at top inner side of the frontal casing, corresponding and matching to a groove provided at top inner side of the rear casing; a rib is projected downwardly from the latch, corresponding and matching to a slit provided at bottom of said groove.

* * * * *